United States Patent [19]

Sinko

[11] Patent Number: 5,062,322

[45] Date of Patent: Nov. 5, 1991

[54] UNIVERSAL LAWN MOWER BLADE SHARPENING MACHINE

[76] Inventor: John E. Sinko, P.O. Box 586, Blanchard, Okla. 73010

[21] Appl. No.: 413,727

[22] Filed: Sep. 28, 1989

[51] Int. Cl.[5] ..... B21K 11/00

[52] U.S. Cl. ..... 76/82.1; 51/125

[58] Field of Search ..... 76/82, 82.1; 51/74 BS, 51/91 BS, 92 BS, 102, 241 R, 241 G, 128, 125

[56] References Cited

U.S. PATENT DOCUMENTS 822,070 5/1906 McLeran ..... 51/128
4,265,146 5/1981 Horrell ..... 51/92 BS
4,333,273 6/1982 Roucau et al. ..... 51/102
4,773,186 9/1988 Kojima ..... 51/102

FOREIGN PATENT DOCUMENTS 16351 1/1985 Japan ..... 51/102

*Primary Examiner*—Roscoe V. Parker

[57] ABSTRACT

A self contained electric motor drive lawn mower blade sharpening machine for use in sharpening most conventional rotary lawn mower blades. The machine includes a base for mounting the motor drive with abrasive wheel, and a free-floating blade guide which allows sharpening of unevenly worn blades to a beveled angle of thirty degrees along the contoured cutting edge.

4 Claims, 3 Drawing Sheets

UNIVERSAL LAWN MOWER BLADE SHARPENING MACHINE

BACKGROUND OF THE INVENTION

1. Field of the Invention

This invention relates to a self contained machine, to be used as a grinder for sharpening most rotary lawn mower blades and blades of like design.

2. Description of the Prior Art

To the best of the inventor's knowledge, no other patents exist which disclose or suggest this invention.

SUMMARY OF THE PRESENT INVENTION

The objective of this invention is to provide a safe, simple and precise machine for sharpening lawn mower blades and similar blades of like design, having a predetermined beveled cutting edge of thirty degrees, as recommended in "A Sharpeners Guide to Bevels and Angles" by David M. Hamre (Copyright 1983).

DESCRIPTION OF THE PREFERRED EMBODIMENT

The Universal Lawn Mower Blade Sharpening Machine consists of a simple box frame F made from twenty gage sheet iron, having pre-drilled flanges to facilitate bolt mounting to a work bench. The motor drive M is a Universal 115 Volt, 60 Hz, 1/10 HP high speed motor (currently 7500 RPM). It is fused by a Buss fuse C, with start-stop operation by push button S. The motor is attached to the frame via a 20 gage steel mounting plate P, and five bolts. Vibration isolators V are used at the bolt locations to attenuate motor and grinding wheel imbalances. The grinding wheel is a composite unit consisting of a basic cup wheel (currently a Norton No. 23A46M8VBE, rated at 10,000 RPM) backed by a steel washer, and again by a resinoid grinding disk. All three components are bonded. The grinding wheel is end-bolted to the drive shaft, and aligned by two Belleville washers. The blade guide B completely envelops the grinding wheel, and consists of a box made from 20 gage sheet iron, with access slots located on the top side of facilitate blade positioning. The blade guide is bolted to the frame by two through bolts, and slotted at this location to permit travel along the motor shaft axis. Shouldered nylon washers between the guide and bolts eliminate binding.

Figure 1:
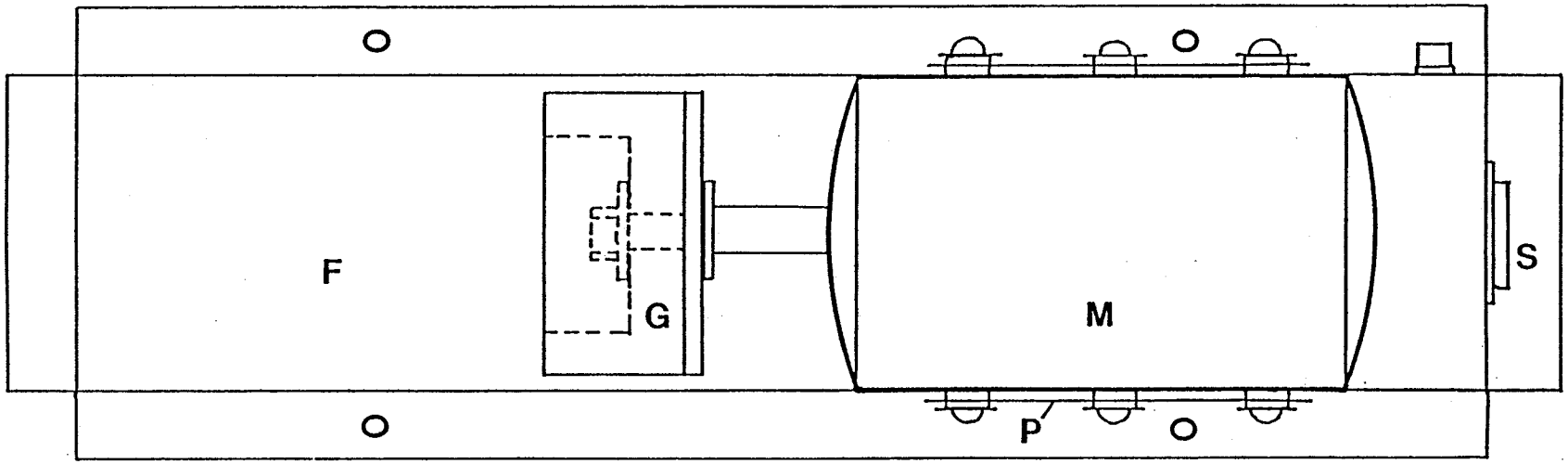
FIG. 1 is a top plan view of the machine, showing the grinding wheel and motor drive assembly with the sliding blade guide removed.
Figure 2:
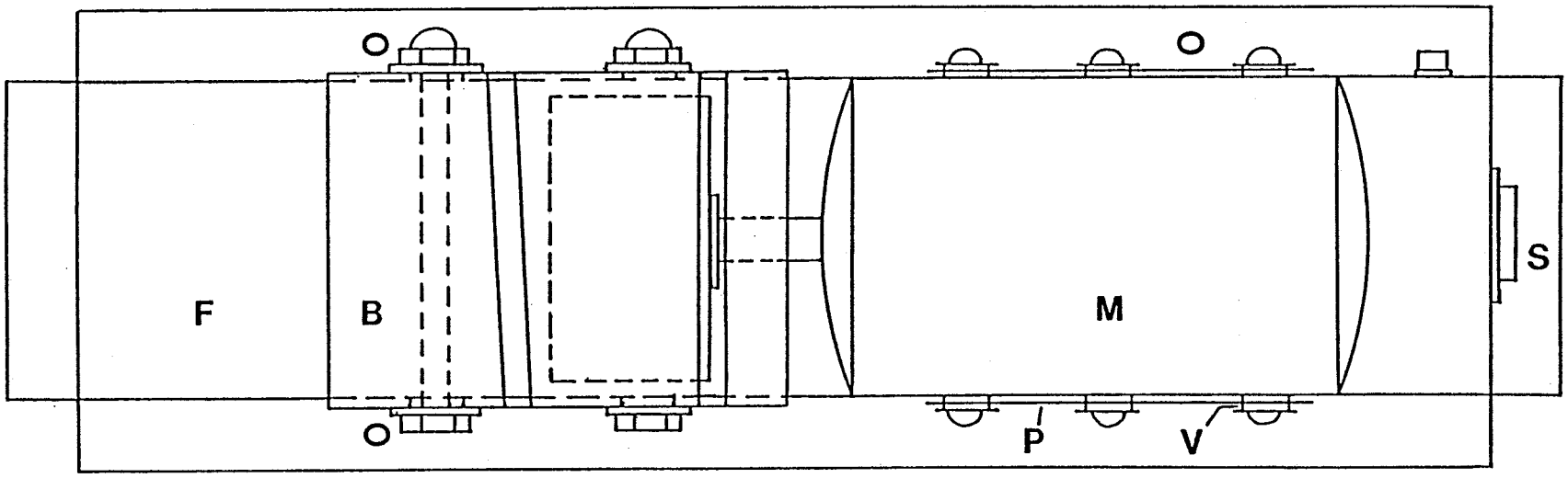
FIG. 2 is a top plan view of the complete machine.
Figure 3:
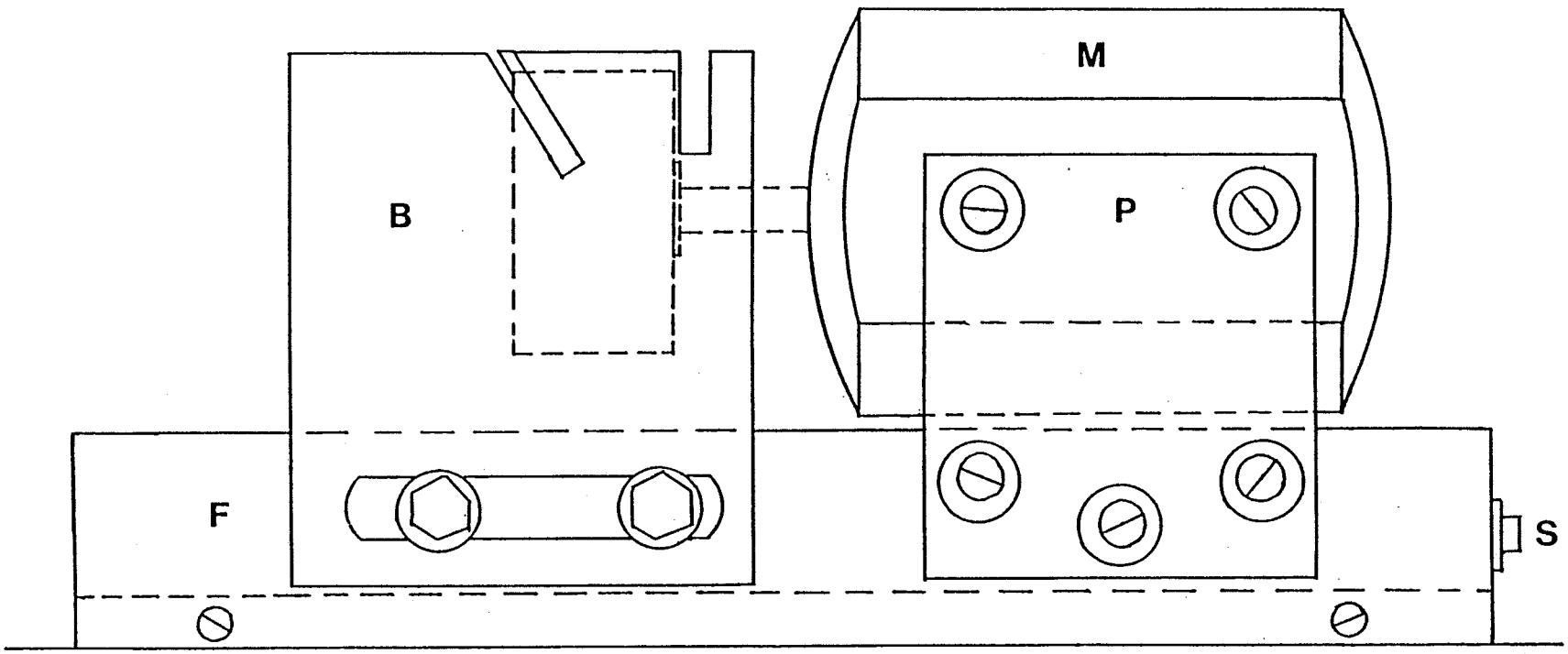
FIG. 3 is a front view of FIG. 2.

In operation (viewing FIG. 3), the function of the vertical access slot in blade guide B is to permit deburring of the flat side of the blade as it is drawn across the flat side of the grinding wheel assembly, i.e. right side. The function of the angled access slot is to allow the beveled side of the blade to be ground at a 30 degree angle to the flat side, as it is drawn across the cupped side of the grinding wheel assembly, i.e. left side. Comparing FIGS. 2 and 3, a compound angle on the angled access slot allows only a ¼ inch cutting surface on the cupped side of the wheel. Since most worn blades have an uneven cutting edge and because the blade guide is free to travel laterally as the blade is drawn across the wheel, a consistent cutting angle of 30 degrees can be ground along the contoured cutting edge of the worn blade.

The use of the machine is quite simple. Viewing FIG. 3, with the blade guide B in the extreme far right position, the blade is inserted in the vertical slot. In this position, the flat side of the blade should be adjacent to the right side of the grinding wheel. With both hands holding the blade, the blade and guide are moved to the left until contact with the wheel is made. Using slight pressure against the wheel, the blade is drawn to and fro through the slot. This procedure will remove any nicks or burrs from the flat side of the blade. Next the guide is moved to the extreme left, and holding the blade as previously described, the blade is inserted in the angled slot and moved to the right until contact with the wheel is made. The to and fro motion is repeated until the desired sharpness is achieved on the beveled edge.

Although the present invention has been described and illustrated, it is not to be so limited since changes and modifications may be made which are within the full scope of the invention.

I claim:

1. A self contained lawn mower blade sharpening machine, said machine comprising;

(a) base means for the purpose of attachment to a work bench;

(b) electric motor means attached to said base means via vibration isolators, for the purpose of providing power to a working surface;

(c) composite abrasive wheel means attached to said motor drive means allowing both sides of the lawn mower blade to be sharpened without machine adjustment; and (d) a laterally traveling blade guide means attached to said base means for grinding both sides of the lawn mower blade;

(e) said blade guide means totally enveloping said abrasive wheel means thereby making it virtually impossible for the operators hand to contact the abrasive wheel means.

2. The device of claim 1 in which said blade guide means incorporates two slotted blade access ports, which are so positioned as to permit both sides of the blade to be ground without a machine re-adjustment.

3. The device of claim 1 in which said blade guide means includes a fixed predetermined angle port, which when in combination with a narrow grinding surface of the abrasive wheel means provides a consistent thirty degree bevel along an uneven cutting edge of the blade.

4. The machine of claim 1 in which said blade sharpening machine can also be used to sharpen most manual hedge trimmer blades or any other beveled edge cutting blade of like design.

* * * * *